US011027808B2

(12) United States Patent
Rogers

(10) Patent No.: US 11,027,808 B2
(45) Date of Patent: Jun. 8, 2021

(54) AEROFOIL SAIL

(71) Applicant: WINDSHIP TECHNOLOGY LIMITED, Hampshire (GB)

(72) Inventor: Simon Mark Rogers, Hampshire (GB)

(73) Assignee: WINDSHIP TECHNOLOGY LIMITED, Hampshire (GB)

( * ) Notice: Subject to any disclaimer, the term of this patent is extended or adjusted under 35 U.S.C. 154(b) by 0 days.

(21) Appl. No.: 14/411,853

(22) PCT Filed: Jul. 1, 2013

(86) PCT No.: PCT/GB2013/051744
§ 371 (c)(1),
(2) Date: Dec. 29, 2014

(87) PCT Pub. No.: WO2014/001824
PCT Pub. Date: Jan. 3, 2014

(65) Prior Publication Data

US 2015/0191234 A1 Jul. 9, 2015

(30) Foreign Application Priority Data

Jun. 29, 2012 (GB) ..... 1211536
Feb. 26, 2013 (GB) ..... 1303409

(51) Int. Cl.
*B63H 9/061* (2020.01)
*B63B 15/00* (2006.01)
*B63H 9/08* (2006.01)

(52) U.S. Cl.
CPC ..... *B63H 9/061* (2020.02); *B63B 15/0083* (2013.01); *B63H 9/08* (2013.01); *B63H 9/0621* (2020.02); *B63H 9/0635* (2020.02)

(58) Field of Classification Search
CPC .... B63H 2009/0635; B63H 2009/0621; B63H 9/0607; B63H 9/06; B63H 9/08;
(Continued)

(56) References Cited

U.S. PATENT DOCUMENTS 4,671,201 A * 6/1987 Yokoyama ..... B63H 9/10 114/102.19
4,856,449 A * 8/1989 Walker ..... B63H 9/0607 114/102.22

(Continued)

FOREIGN PATENT DOCUMENTS

DE 3130479 5/1983
EP 0052955 6/1982

(Continued)

OTHER PUBLICATIONS

International Search Report for International Application No. PCT/GB2013/051744 filed Jul. 1, 2013.

(Continued)

*Primary Examiner* — Daniel V Venne
(74) *Attorney, Agent, or Firm* — Alston & Bird LLP

(57) ABSTRACT

An aerofoil sail (30) for providing motive power to a waterborne vessel, the sail comprising a leading aerofoil portion (35*a*) and a trailing aerofoil portion (35*b*), and the sail comprising a spar (32), at least one of the aerofoil portions rotatably positionable, and the sail comprising a controller to control individually the angular position of at least one of the aerofoil portions relative to the spar, and the spar rotationally positionable about its longitudinal axis.

15 Claims, 11 Drawing Sheets

(58) Field of Classification Search
CPC ..... B63H 2009/06; B63H 2009/0607; B63H 2009/0657; B63H 2009/08; B63B 15/0083; B63B 2015/0016; B63B 2015/0083
USPC ... 114/39.21, 39.22, 39.29, 39.31, 39.32, 89, 114/90
See application file for complete search history.

(56) References Cited

U.S. PATENT DOCUMENTS

| | | | | |
|---|---|---|---|---|
| 5,027,735 | A | 7/1991 | Labrador | |
| 5,320,310 | A | 6/1994 | Mitchell | |
| 5,575,233 | A | 11/1996 | Walker | |
| 6,341,571 | B1 * | 1/2002 | Russell | B63B 1/125 114/102.1 |
| 7,712,427 | B2 | 5/2010 | Ott et al. | |
| 9,422,043 | B2 * | 8/2016 | Englebert | B63H 9/0607 |
| 2012/0285354 | A1 * | 11/2012 | Hoyt | B63H 9/0607 114/102.13 |

FOREIGN PATENT DOCUMENTS

| | | | |
|---|---|---|---|
| JP | S61 108096 | | 5/1986 |
| JP | S64-14599 | U | 1/1989 |
| JP | H10-218084 | A | 8/1998 |
| JP | 2012-520209 | A | 9/2012 |
| NZ | 227717 | A | 8/1990 |
| WO | WO 98/21089 | A1 | 5/1998 |
| WO | WO 01/89923 | A1 | 11/2001 |

OTHER PUBLICATIONS

Written Opinion from International Patent Application No. PCT/GB2013/051744, dated Oct. 4, 2013, 4 pages.
Office Action for European Patent Application No. 13 733 453.8 dated Jan. 18, 2018, 6 pages.

* cited by examiner

AEROFOIL SAIL

CROSS-REFERENCE TO RELATED APPLICATIONS

This application is a U.S. National Phase under 35 U.S.C § 371 of International Application PCT/GB2013/051744, filed Jul. 1, 2013, which claims priority to GB 1211536.6, filed Jun. 29, 2012, and GB 1303409.5, filed Feb. 26, 2013, each of which is incorporated herein in its entirety by reference.

TECHNICAL FIELD

The present invention relates generally to propulsion of waterborne vessels. In one embodiment, there is provided an aerofoil sail the control of which is substantially automated.

BACKGROUND

The current level of fuel consumption, and the resulting Co2 emissions, and other hydrocarbon bi-products, resulting from commercial shipping is extremely high. We have realised that there is a need to address this issue and we have devised an auxiliary power supply for commercial shipping to help reduce both fuel consumption and emissions.

SUMMARY

According to a first aspect of the invention there is provided an aerofoil sail for providing motive power to a waterborne vessel, the sail comprising a leading aerofoil portion and a trailing aerofoil portion, and the sail comprising a spar structure, at least one of the aerofoil portions rotatably positionable, and the sail comprising a controller to control individually the angular position of at least one of the aerofoil portions relative to the spar structure, and the spar structure rotationally positionable about its longitudinal axis The controller preferably performs automated control of the least one aerofoil portion and the spar, preferably with no or minimal manual intervention. The controller may use feedback signals from one or sensors (incorporated, associated with or affecting the sail) in order to determine a suitable control signal.

One of the aerofoil portions may be rigid with the spar, and the other aerofoil portion may be rotatably positionable about the spar.

The spar may be capable of being rotatably positionable, about its longitudinal axis, to a required (angular) position.

Both of the aerofoil portions may be pivotably positionable about the spar.

When aligned, the leading portion and the trailing portion may form an aerofoil profile.

A space or gap between the heading portion and trailing portion is provided to allow the flow of air therethrough, preferably substantially unimpeded.

The trailing portion is preferably longer than the leading portion when viewed in plan. The leading portion may be longer than the trailing portion when viewed in plan.

The leading portion may have greater width at its widest point compared to the greatest width of the trailing portion, when viewed in plan.

The sail wing preferably comprises multiple sets of leading portions and trailing portions, each set of a leading portion and a trailing portion arranged one above the other.

Each set of a leading portion and a trailing portion is at substantially the same vertical position.

Each of the trailing portions and the leading portions comprises a leading flap and a trailing flap.

Preferably at least one of the leading and trailing portions is pivotable through around sixty degrees.

Each of the leading and trailing portions may be driveable on a curved track.

The leading and trailing portions may be viewed as flaps.

Preferably each of the leading and trailing portions are pivotable by way of toothed gear arrangements. Preferably each of toothed gear arrangements comprises a rack and pinion.

Preferably a centre of effort of the sail is located anterior of a centreline of the spar.

The internal volume of the spar is sized so as to allow an operative access thereinto. The spar is preferably sized so as to allow an operative access within the spar for a major portion of the length of the spar. The internal space of the spar preferably comprises at least one ladder to allow access to different parts of the spar.

In one embodiment of the invention maintenance of the sail underway is completed either at deck level or internally in the main spar. A man sized hatch may be positioned above the top bearing near working deck level to allow access to the internal area of the spar. A series of staggered ladders are positioned to reduce the danger of falling too far within the internal space. All the systems and motors that need maintenance whilst at sea or alongside can be accessed from the internal ladders. Harness lines and track systems may be supplied for health and safety.

Another aspect of the invention relates to a sail assembly/rig comprising multiple sails of the first aspect of the invention.

In one embodiment, the spar rotates on two bearings in the ship and can be rotated by a geared motor at deck level. The leading edge (LE) and trailing edge (TE) flaps are preferably mounted on two tracks per flap which are attached to the main spar. The flaps are lifted in to position at approximately ninety degrees to the centreline of the main spar and the sliders on the flap engaged with the tracks on the main spar. Once located, the flap is rotated so that the centrelines line up.

The sail is preferably a substantially rigid structure. The leading and trailing portions are preferably rigid structures.

In one embodiment of the invention the sail comprises a main central spar that rotates on two bearings set in the ships main deck and internal structure and can be rotated with a geared motor. The sail has multiple LE and TE flaps that are rotatable around the main spar, again driven by geared motors. The LE and TE flaps can be driven to produce an asymmetric lifting surface from either the port or starboard side of the vessel. The flaps can also be arranged so that whilst being an efficient lifting surface they can also move the centre of effort of the sail to line up with the central axis of the main spar and 'self balance'. The centre of effort of the sail with the LE and TE flaps on centreline is preferably sufficiently far behind the centreline of the main spar and hence always weather cocks/aligns with the wind as a fail safe position.

The sail may include one or more features as shown in the detailed description and/or in the drawings.

According to a third aspect of the invention there is provided a waterborne vessel comprising at least one sail of the first aspect of the invention.

The vessel may be a cargo vessel.

The above or further aspects of the invention may include a combination of the above features and/or any of the features mentioned in the detailed description and/or drawings.

BRIEF DESCRIPTION OF THE DRAWINGS

Various embodiments of the invention will now be described, by way of example only, with reference to the following drawings in which.

DETAILED DESCRIPTION

Figure 1:
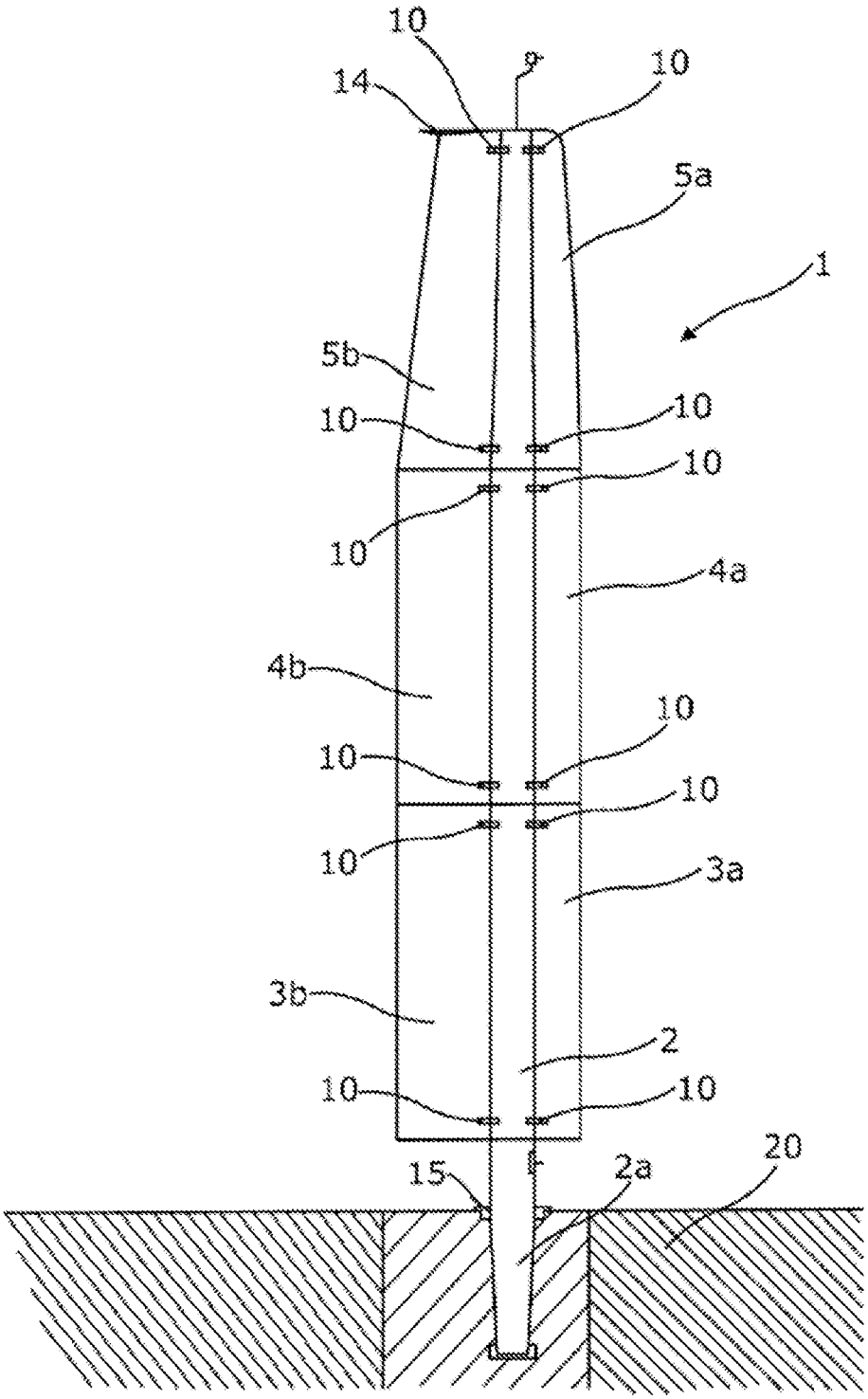
FIG. 1 is a side view of an aerofoil sail.

With reference initially to FIG. 1 there is shown an aerofoil, or 'wing', sail 1, for a ship or waterborne vessel, and in particular for a cargo vessel. As will be described below, the sail provides auxiliary power to a propeller driven vessel and thereby reduces the fuel required to power the propeller. Broadly, the principle of operation is to harness the power of the wind using a highly efficient wing rig which can be simply controlled, largely automatically, from the bridge of the ship and be maintained underway.

The sail 1 comprises a spar 2 to which are mounted sets of leading and trailing portions, each leading portion and each trailing portion forming a respective pair, located at a respective height of the spar 2. Each of leading and trailing portions is formed of a rigid material, and may be hollow or solid. There are provided leading and trailing edge portions 3*a* and 3*b*, leading and trailing edge portions 4*a* and 4*b*, and leading and trailing edge portions 5*a* and 5*b*. As can be seen in FIG. 1, the lowermost sets of leading and trailing portions, 3*a*, 3*b*, 4*a* and 4*b* are of parallel profile, whereas the uppermost set 5*a* and 5*b* are of tapered profile.

The uppermost part of the trailing portion 5*b* is provided with a winglet 14.

The leading and trailing edge portions are mounted for pivotable or rotatable movement about the spar by way of rack and pinion arrangements, shown generally at 10, so that the angular position of each of the portions can be controlled. Each such arrangement may be in the form of a rack and slider. Each leading and trailing edge portion comprises an upper rack and pinion device and a lower rack and pinion device. Each pair of rack and pinion devices arranged to control the angular position of the portion relative to the spar 2. For each rack and pinion device one of the rack component and the pinion component is attached to the leading/trailing portion, and the other of the rack component and the pinion component is attached to the spar.

The angular position of each of the leading and trailing edge portions is individually controllable by way of the respective rack and pinion arrangement, or other actuator. A driver for each pair of the rack and pinion arrangements is provided by hydraulic pressure source or electrical pressure source, which provides a directional driving force.

Figure 2:
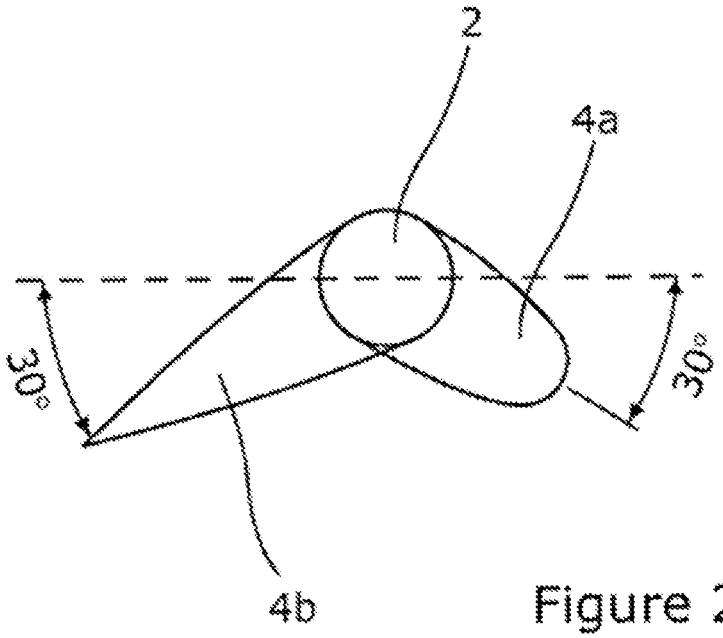
FIG. 2 is a lateral cross-section of the sail of FIG. 1 in a first condition.
Figure 3:
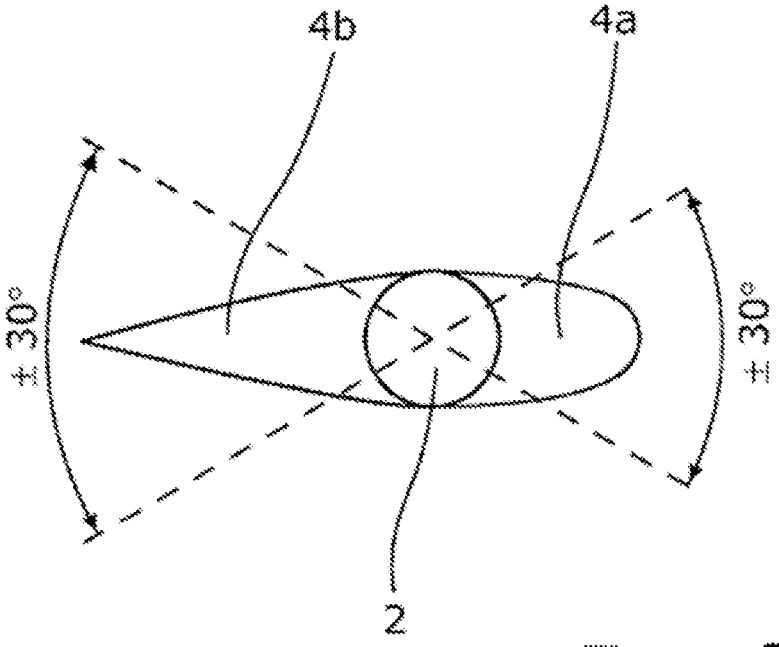
FIG. 3 is a lateral cross-section of the sail of FIG. 1 in a second condition.
Figure 4:
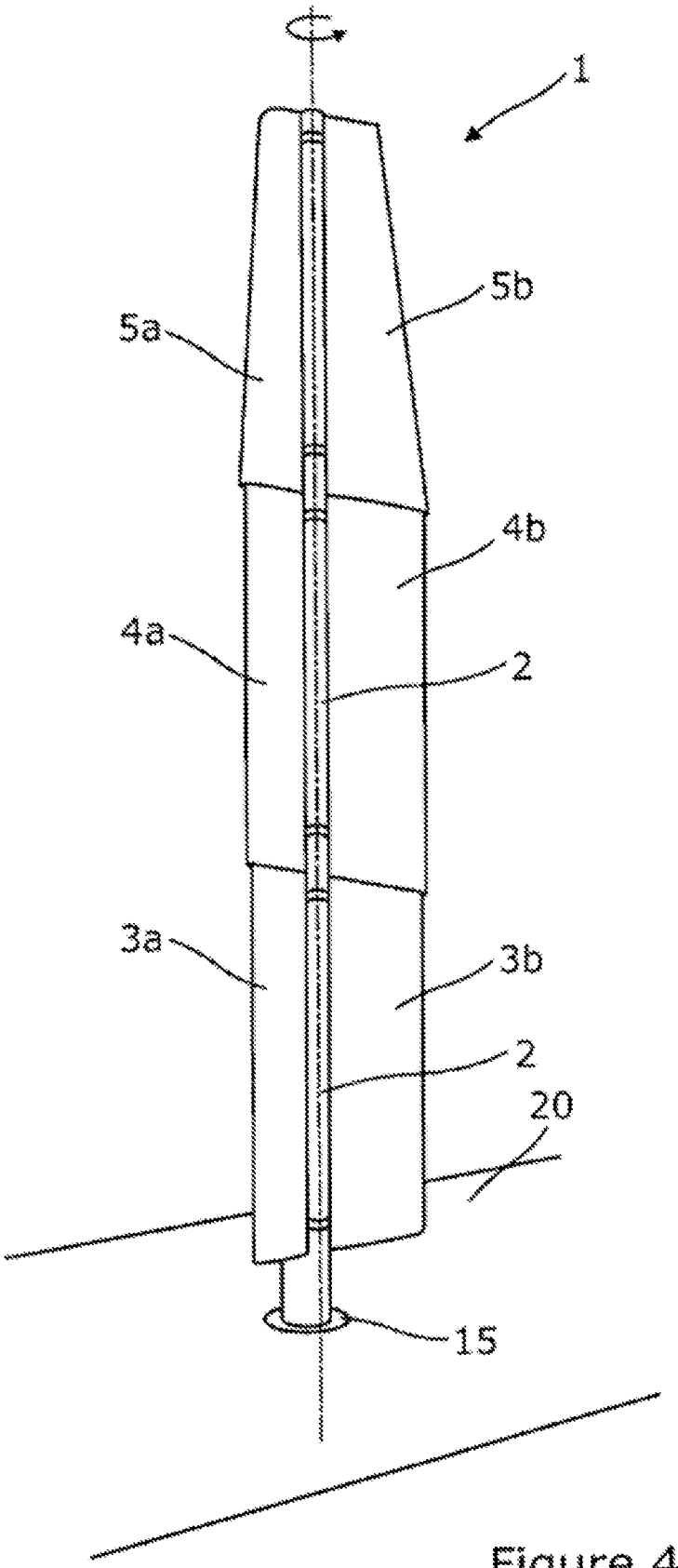
FIG. 4 is a perspective view of the sail of FIG. 1.

With reference to FIGS. 2 and 3, the angular extent of movement for each portion is shown, in this case, each leading and trailing edge portion is capable of movement through sixty degrees, thirty degrees to each side of a centreline. As can be seen, the trailing edge portions are longer than the leading edge portions. When the portions are aligned, an overall aerofoil shape is formed.

The spar 2 is of substantially hollow construction, and comprises a basal portion 2*a*, which is of tapered shape. The basal portion 2*a* is received in an aperture in the deck 20 and is arranged for rotational movement about its longitudinal axis. There is provided a upper bearing 15*a* and a lower bearing 15*b* which allow the rotational movement. The rotational movement is brought about by way of a drive arrangement, which may be powered hydraulically. The drive arrangement (not shown) may comprise a toothed collar provided around the spar which is driven by a drive cog, or similar. The drive arrangement provides a geared motor. The drive arrangement is controlled by a controller system 200.

In order to permit maintenance of the sail, the spar comprises an opening 17 which allows an operative to enter into the spar 2. The internal volume of the spar 2 is such that an operative can move within the internal space and access different heights therein by way of staggered ladders (not shown) attached to the internal walls of the spar. Advantageously, in this way an operative can perform maintenance work more safely than if he had to access the sail externally. For example, by allowing such internal access, the operative can work on repairing, replacing or checking the rack and pinion devices from the relative safety of within the spar 2.

For installation of each leading and trailing portion of the sail 2, once the portion is positioned on centreline the motor gear is fitted from inside the spar and meshed with the semi circular horizontal racked gear on the aft surface of the flap. As the motor gear rotates the flap slides on the track to the desired position. The tracks and sliders are machined to be self aligning to advantageously allow for the spar to bend and still operate under load.

A further embodiment of the invention is now described which comprises a sail assembly 30.

Figure 6:
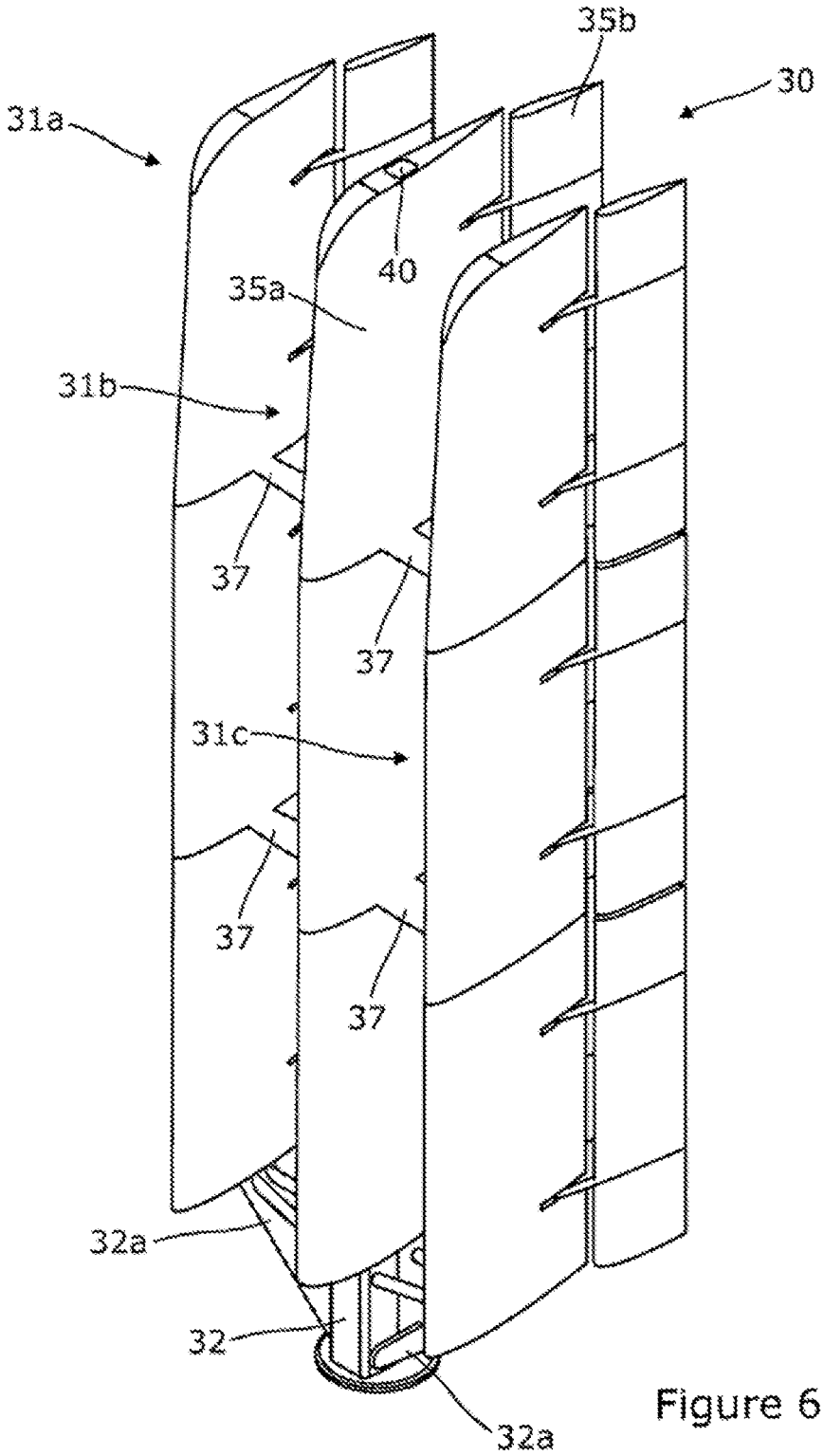
FIG. 6 is front perspective view of a sail assembly.
Figure 7:
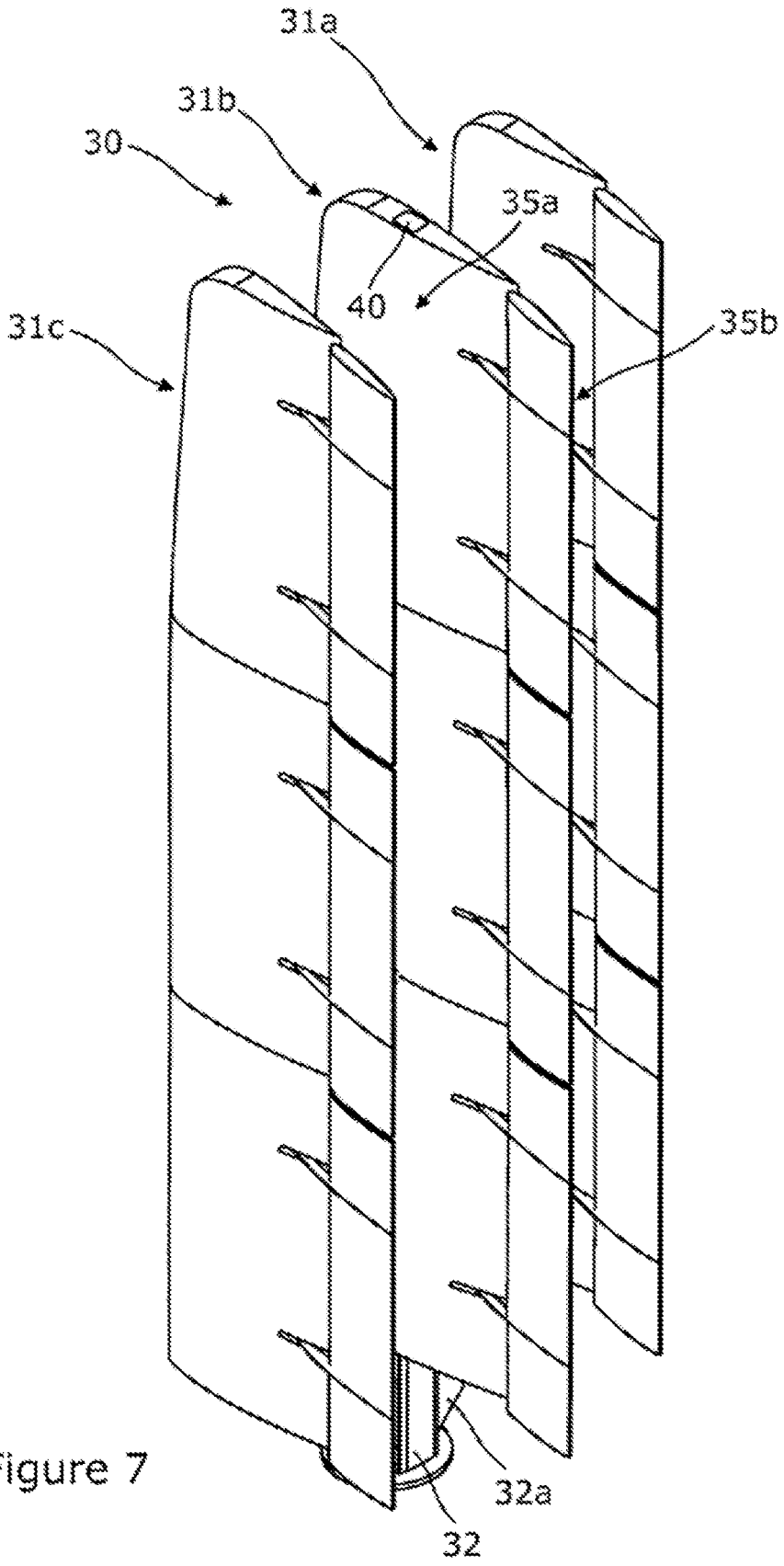
FIG. 7 is a rear perspective view of a sail assembly.

The sail assembly 30 comprises three spaced apart aerofoil sails (arranged in side-by-side arrangement) 31*a*, 31*b* and 31*c*. Each sail comprises sets of leading and trailing portions, each leading portion 35*a* and each trailing portion 35*b* forming a respective pair, located at a respective height of the spar 2. Each of leading and trailing portions is formed of a rigid material, and may be hollow or solid. A gap 120 is provided between each of leading portions and the trailing portions (see FIG. 6).

The sail 31*b* is a central sail, and is supported by a spar 32. Support members 32*a* which extend from the spar 32, support the sails 31*a* and 31*c*. The spar 32 extends through the sail 31*b*, and support members 32*a* support spars (not illustrated) which extend through the leading portions of the outer sails 31*a* and 31*c*. The sails are maintained in a spaced-apart relationship by way of connection portions 37 which connect the leading portions of the outer sails to the leading portions of the central sail.

The trailing edge portions are mounted for pivotable or rotatable movement (for example, by way of rack and pinion arrangements), such that the angular position of each of the portions can be controlled. Each such arrangement may be in the form of a rack and slider.

The angular position of each of the trailing portions is individually controllable by way of a respective actuator. A driver for each trailing portion may be provided by hydraulic pressure source or electrical power, which provides a directional driving force.

Figure 8A:
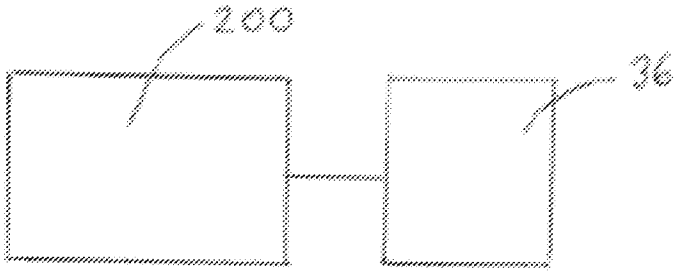
FIG. 8A illustrates the control system connected to the actuator according to an example embodiment.
Figure 8:
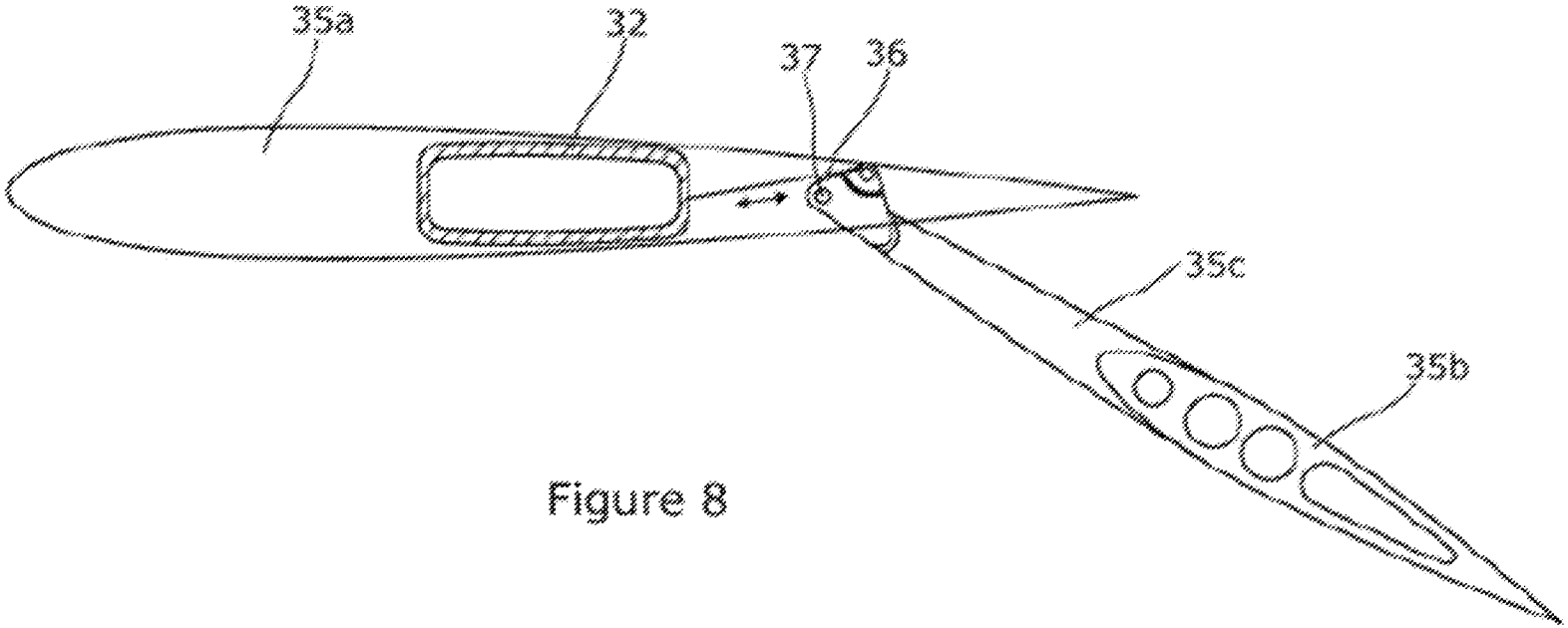
FIG. 8 is a plan view of a leading and trailing edge in a first position of a sail of the sail assembly of FIG. 7.
Figure 9:
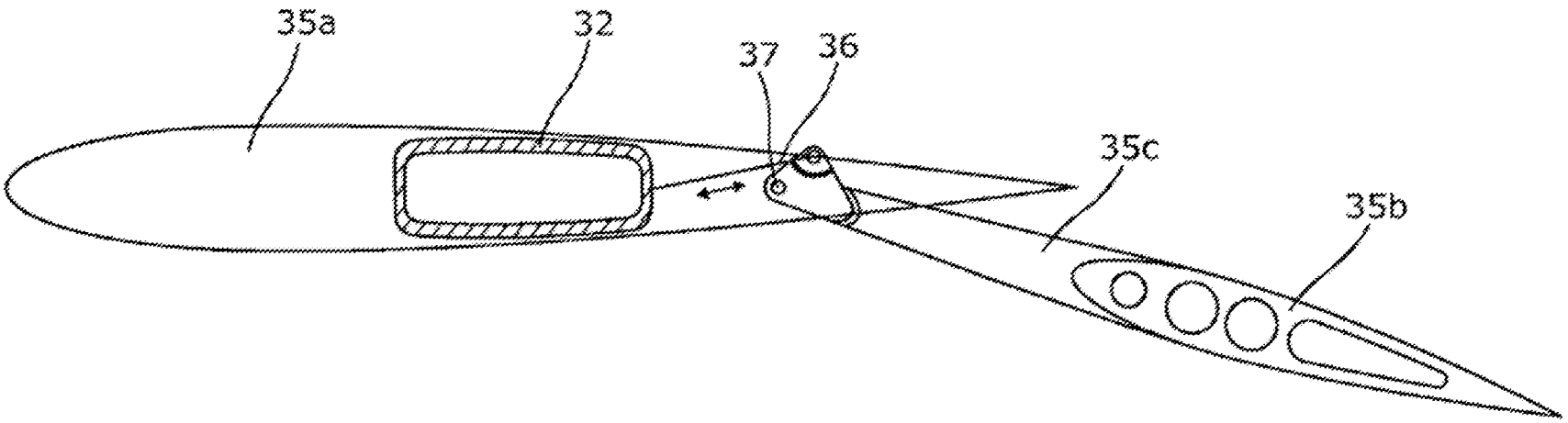
FIG. 9 is a plan view of a leading and trailing edge in a second position of a sail of the sail assembly of FIG. 7.
Figure 10:
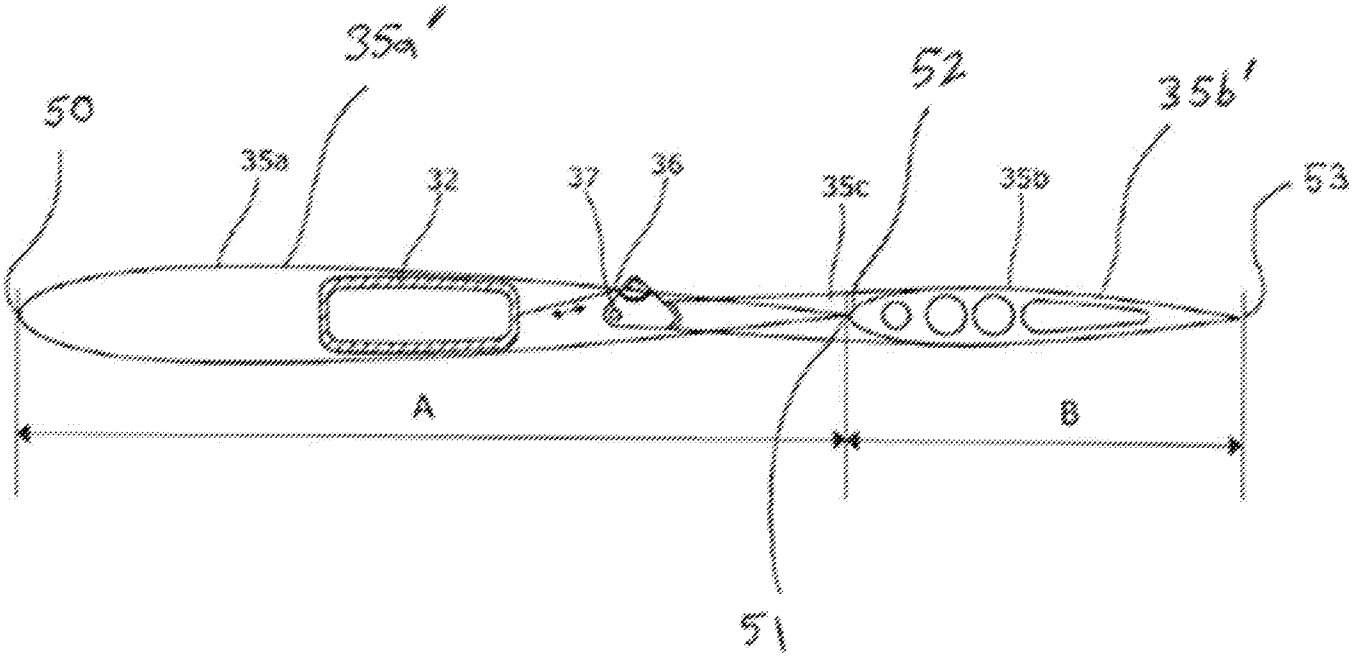
FIG. 10 is a plan view of a leading and trailing edge in a third position of a sail of the sail of the sail assembly of FIG. 7.

With reference to FIGS. 8, 9 and 10, the angular extent of movement for each trailing portion is shown. In this case, each trailing edge portion is capable of movement through sixty degrees, thirty degrees to each side of a centre-line. As can be seen the leading portions are longer than the trailing portions. Each of the leading portions and the trailing portions has an external aerodynamic surface 35*a*' and 35*b*'. The distance between the distal end regions 50 and 51 of the leading portion 35*a* is shown by the reference letter A, and the distance between the distal end regions 52 and 53 is shown by the reference letter B. The actuator 36 may comprise a reciprocal rod, for example comprising a ram.

Each of the leading and trailing portions forms an aerofoil shape. Each trailing portion is connected to its respective trailing edge by way of two arms 35*c*. A distal end of each arm 35*c* is connected to a pivot 37, and the arm being capable of being controllably driven about the pivot. With the trailing portion and the leading portion in an aligned position (as shown in FIG. 10), said portions are spaced from one another. The position of the pivot connection 37 is preferably at a position of ten to thirty percent along the overall length of the sail (ie from the distal end of the trailing portion to the distal end of the leading portion).

The spar 32 is of substantially hollow construction, and comprises a basal portion (similar to the basal portion 2*a*), which is of tapered shape. The basal portion is received in an aperture in the deck 20 and is arranged for rotational movement about its longitudinal axis. There is provided an upper bearing at deck level and a lower bearing at below deck level, which allow the rotational movement of the spar. The rotational movement is brought about by way of a drive arrangement, which may be powered hydraulically. The drive arrangement (not shown) may comprise a toothed collar provided around the spar which is driven by a drive cog, or similar. The drive arrangement provides a geared motor. This allows the entire sail assembly to be controllably rotated.

The sail assembly is provided on spherical bearings, which are preferably provided with a constant recirculating oiling pump to keep bearings lubricated.

A maintenance hatch 40 is provided at the top of the spar to allow attachment or release of lifting strops.

The sail assembly 30 advantageously provides an increase in efficiency with accelerated flow over the trailing portion allowing the coefficient of lift to be increased significantly. We have found that the lift coefficient of the sail assembly 30 is 2.5 in comparison to 1.4 for the sail 1.

The or each sail can be made from a combination of ferrous and non ferrous metals and also from composites such as fibre reinforced plastics. It is envisaged that due to the force the sail will experience at sea that high strength steels will be best suited.

It will be appreciated that although three pairs of leading and trailing portions are shown for the/each sail, in other embodiments, more or fewer pairs may be provided.

In use, one or more of the sails or sail assemblies are mounted on the deck of a ship. The sails/sail assemblies could be provided aligned with the centreline of the vessel, offset from the centreline (i.e. towards the starboard or port side), or a combination of those. The control system 200 is provided to allow control of each leading and/or trailing portion of each sail. A feedback system using load sensors incorporated with the or each spar could be used to control the angular position of each leading and trailing portion, together with the rotational position of the spar. Feedback using information from other sensors, and indeed other types of sensors could be used in addition or alternatively. The control system, which comprises a data processor provided with executable instructions, processes signals from the sensors and is arranged to output control signals to each of the leading and trailing edge portions, as well as control signals for the rotational position of the spar, using feedback information from the sensors. In this way control of the sail(s) can largely be controlled automatically. It will be appreciated, however, that the control system allows for manual intervention as and when required. In that regard, control may be from the bridge of the vessel, and from a second control point next to the (or each) sail/sail assembly.

Figure 5:
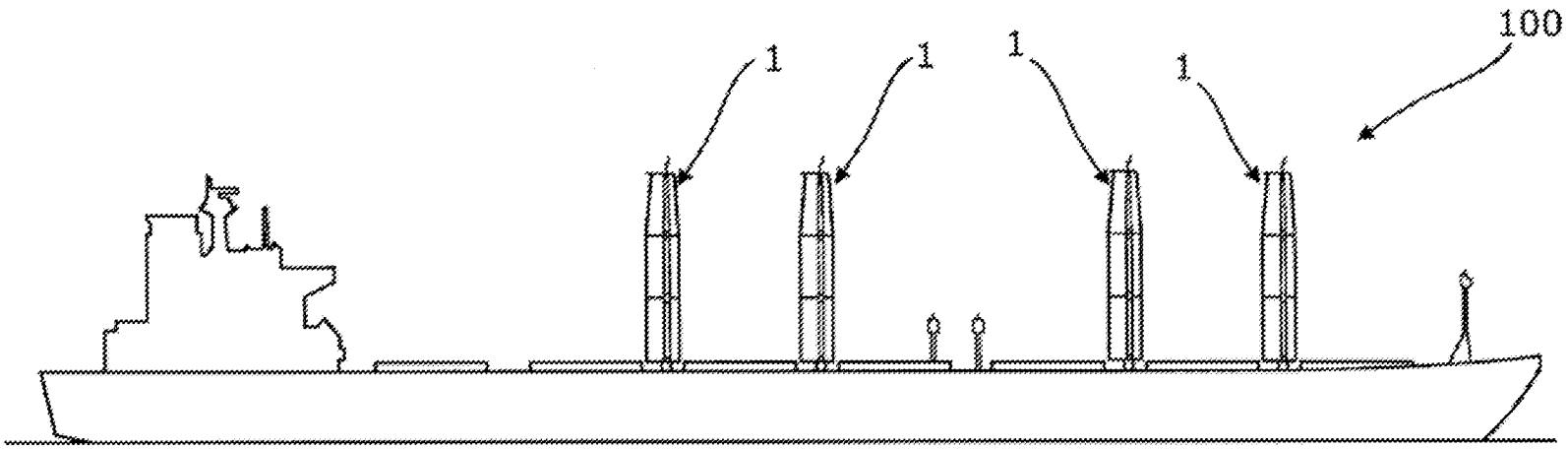
FIG. 5 is a side view of a vessel provided with the aerofoil sail of FIG. 1.
Figure 11:
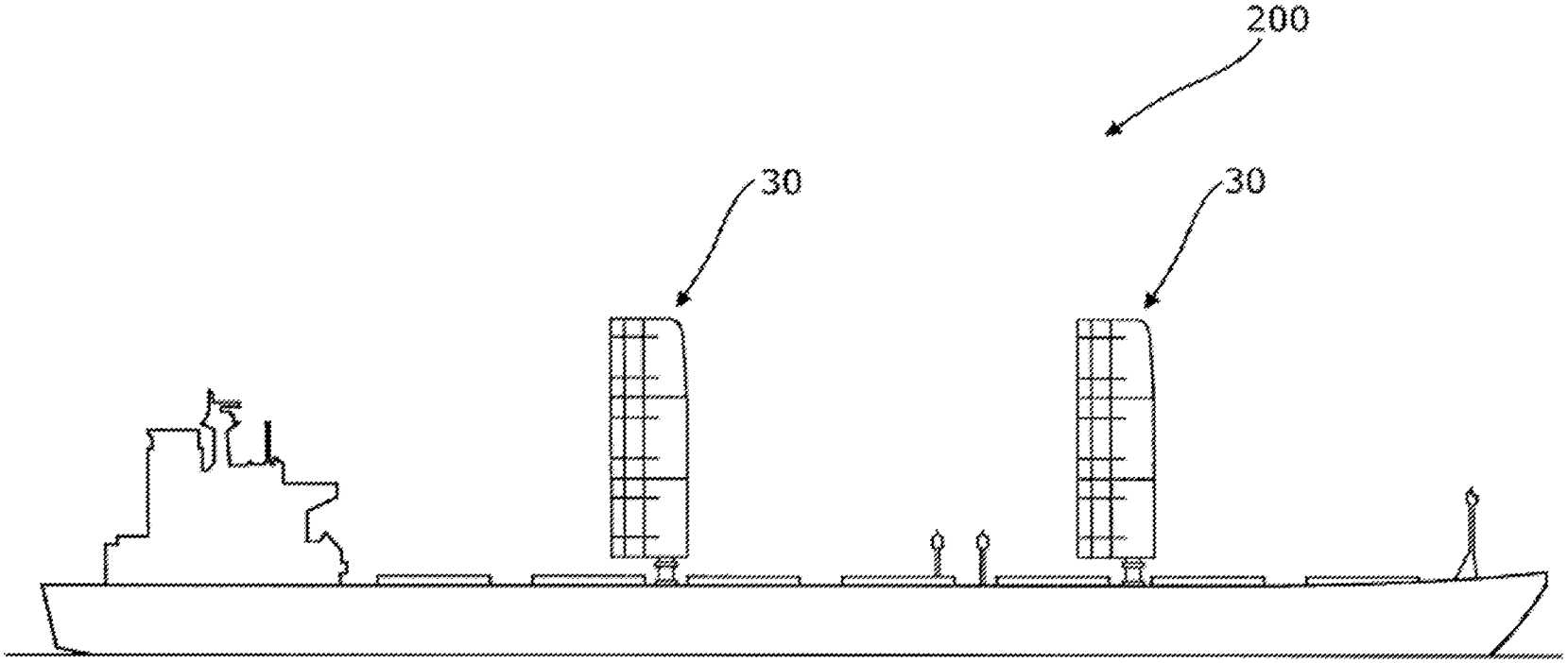
FIG. 11 is a side view of a vessel provided with sail assemblies of FIG. 7.

Reference is made to FIG. 5 which shows a cargo vessel 100 which is provided with four sails 1 along the centreline of the vessel, and to FIG. 11, which shows a vessel 200.

Because each of the leading and trailing portions is controllable individually, the configuration of each sail can be tailored to maximise the available wind conditions (as indicated by the onboard sensors), and thereby maximise the propulsive power provided by the sail(s). In certain circumstance, however, the sails may need to be configured to minimise the propulsive power, for example when the vessel needs to reduced or substantially no motive power.

With sails at each end of the ship, advantageously it will be possible to steer the ship on long passages and help reduce the rudder drag which is considerable on large vessels. Additionally, in port the sails could advantageously be utilised as thrusters for manoeuvring and at sea they will help greatly stabilising the dynamic roll of the ship.

Figure 12:
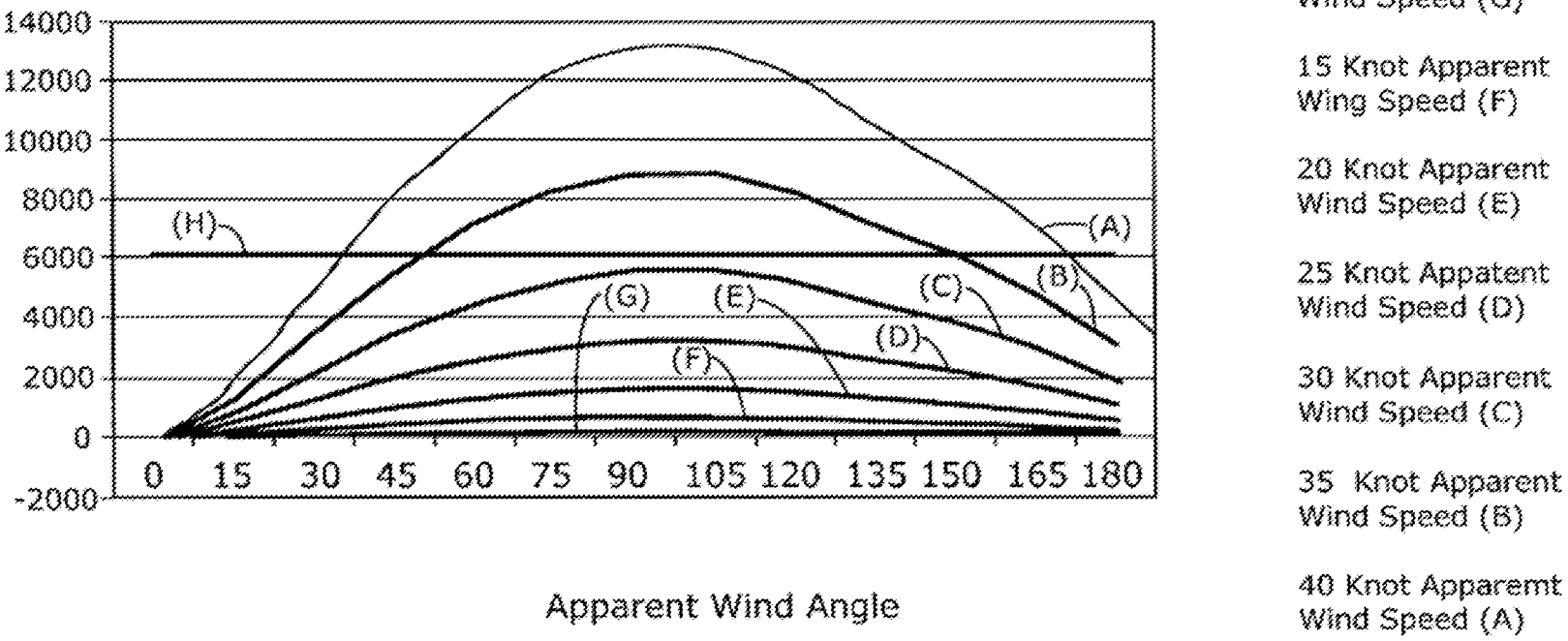
FIG. 12 is a power curve graph.

The control system for multiple wings ensures the safe operation of such a powerful device. With such power which can be harnessed from the sails, the required fuel consumption can advantageously be significantly reduced. FIG. 12 shows various power curves for two of the sail assemblies 30 (which allows for 30% losses from aero test data).

It is envisaged that multiple sails/sail assemblies will be fitted to a ship and positioned to minimise disturbance for loading and off-loading operations. Advantageously, the sails are robust, tall and high aspect ratio and should not impede most overhead cranes.

Due to the high displacement of a commercial ship the righting moment that will resist the heeling force will be very large and a stable five degree heel due to the wings should be a maximum. This is clearly going to depend on each ship, case by case. The reality is the bigger the ship the better this system works.

Side force and due to this being an auxiliary power supply the ship will always be making approximately 13 knots (standard commercial speed). There will always be side force produced by the hull moving through the water at approximately thirteen knots and hence the side force of the wings should have little effect.

The sail being rigid is advantageously extremely predictable and is largely self balancing, the forces to control it will be very low. The control system will be fail-safe, ie the wings automatically line up with the wind. If built in steel and powered by hydraulic motors this will be much more appealing to the shipping industry as these are well understood and very reliable technologies.

In an alternative embodiment, the trailing portion of each pair is rigidly fixed to the spar, and the leading portion is mounted for controlled angular movement relative to the trailing edge. By virtue of the spar being rotatable about itself, the angular position of the fixed portion relative to the longitudinal axis of the spar can be altered in a controlled fashion.

In an embodiment, the outer surfaces of the sail/sails may be provided with solar panels, from which the power sourced can be used to drive the angularly controllable portions.

In another embodiment, the bearings which mount the spar are both provided above deck, by way of a spigot or socket housing. It will be appreciated that more than two bearings may be provided.

The spar bearings for the above embodiments are self-aligning, with a tube connecting them for watertight integrity, and to allow self-alignment when the sail/sail assembly is lifted into position.

The above embodiments include failsafe mechanisms which will weather cock, and the actuatable leading/trailing portions comprise hydraulic or electrical lead screw actuators which will release and allow the portions to naturally find a neutral position.

Preferably, the or each spar is accessible at all heights thereof to allow maintenance or survey by an operator. This is achieved by providing man-sized openings and access ways to/within the spar/s.

The invention claimed is:

1. An aerofoil sail assembly for providing motive power to a cargo vessel, comprising three aerofoil sails, each aerofoil sail comprising a leading aerofoil portion and a trailing aerofoil portion, and the aerofoil sail assembly comprising a spar defining a longitudinal axis and a height along the longitudinal axis, at least one of the aerofoil portions rotatably positionable, wherein an angular position of at least one of the aerofoil portions controllable relative to the spar, and the spar rotationally positionable about the longitudinal axis, and each of a leading portion and a trailing portion comprising a respective external aerofoil surface and wherein a distance between distal end regions of the external aerofoil surface of the leading portion in a direction transverse to the height of the spar is longer than a distance between distal end regions of the aerofoil surface of the trailing portion in the direction transverse to the height of the spar, and a gap is provided between the leading portion and the trailing portion, and wherein the three aerofoil sails provided in a side-by-side spaced apart relationship, and a leading aerofoil portion of a central aerofoil sail of said three aerofoil sails having a height, and the spar extending internally of said leading aerofoil portion of said central aerofoil sail and for the height of said leading aerofoil portion of said central aerofoil sail, and the spar comprising an internal volume sized to allow operative access for a major portion of a length of the spar.

2. An aerofoil sail assembly as claimed in claim 1 in which a controller performs automated control of the least one of the leading aerofoil portion and the trailing aerofoil portion and the spar.

3. An aerofoil sail assembly as claimed in claim 2 in which the controller may use feedback signals from one or more sensors, wherein the one or more sensors are operatively connected to the sail in order to determine a suitable control signal.

4. An aerofoil sail assembly as claimed in claim 1 in which one of the leading aerofoil portion and the trailing aerofoil portion is rigid with the spar, and the other aerofoil portion is rotatably positionable relative to the spar.

5. An aerofoil sail assembly as claimed in claim 1 in which both of the aerofoil portions are pivotably positionable relative to the spar.

6. An aerofoil sail assembly as claimed in claim 1 in which when aligned, the leading portion and the trailing portion form an aerofoil profile.

7. An aerofoil sail assembly as claimed in claim 1 in which each portion is of aerofoil shape when viewed in plan.

8. An aerofoil sail assembly as claimed in claim 7 in which the at least one rotatably positionable aerofoil portion is rotatable connected to a fixed aerofoil portion.

9. An aerofoil sail assembly as claimed in claim 1, wherein a set of leading and trailing portions is arranged above another such set.

10. An aerofoil sail assembly as claimed in claim 9 in which each set of a leading portion and a trailing portion is at substantially a same vertical position.

11. An aerofoil sail assembly as claimed in claim 9 in which each of the trailing portions and the leading portions comprises a leading edge and a trailing edge.

12. An aerofoil sail assembly as claimed in claim 1 in which at least one of the leading and trailing portions is pivotable through around sixty degrees.

13. An aerofoil sail assembly as claimed in claim 1 in which a centre of effort of the sail is located anterior of a centreline of the spar.

14. An aerofoil sail assembly as claimed in claim 1 in which the sail is a substantially rigid structure.

15. An aerofoil sail assembly as claimed in claim 1 in which the spar supports the aerofoil portions.

* * * * *